US010957303B2

(12) United States Patent
Tachibana et al.

(10) Patent No.: US 10,957,303 B2
(45) Date of Patent: Mar. 23, 2021

(54) TRAINING APPARATUS, SPEECH SYNTHESIS SYSTEM, AND SPEECH SYNTHESIS METHOD

(71) Applicant: NATIONAL INSTITUTE OF INFORMATION AND COMMUNICATIONS TECHNOLOGY, Tokyo (JP)

(72) Inventors: Kentaro Tachibana, Tokyo (JP); Tomoki Toda, Aichi (JP)

(73) Assignee: NATIONAL INSTITUTE OF INFORMATION AND COMMUNICATIONS TECHNOLOGY, Tokyo (JP)

( * ) Notice: Subject to any disclaimer, the term of this patent is extended or adjusted under 35 U.S.C. 154(b) by 28 days.

(21) Appl. No.: 16/489,583

(22) PCT Filed: Feb. 21, 2018

(86) PCT No.: PCT/JP2018/006166

§ 371 (c)(1),
(2) Date: Dec. 4, 2019

(87) PCT Pub. No.: WO2018/159403

PCT Pub. Date: Sep. 7, 2018

(65) Prior Publication Data

US 2020/0135171 A1 Apr. 30, 2020

(30) Foreign Application Priority Data

Feb. 28, 2017 (JP) ..... JP2017-037220

(51) Int. Cl.
*G10L 13/06* (2013.01)
*G10L 13/10* (2013.01)
(Continued)

(52) U.S. Cl.
CPC ..... *G10L 13/047* (2013.01); *G10L 13/10* (2013.01); *G10L 25/75* (2013.01)

(58) Field of Classification Search
CPC ..... G10L 13/06; G10L 13/10; G10L 19/06
See application file for complete search history.

(56) References Cited

U.S. PATENT DOCUMENTS 4,301,329 A * 11/1981 Taguchi ..... G10L 25/00 704/217
4,890,328 A * 12/1989 Prezas ..... G10L 19/08 704/223

(Continued)

FOREIGN PATENT DOCUMENTS

JP H03-269599 A 12/1991
WO WO-2009/022454 A1 2/2009

OTHER PUBLICATIONS

A. van den Oord et al., "WaveNet: A Generative Model for Raw Audio," arXiv preprint arXiv:1609.03499, 2016.

(Continued)

*Primary Examiner* — Shreyans A Patel
(74) *Attorney, Agent, or Firm* — Marshall, Gerstein & Borun LLP

(57) ABSTRACT

A training apparatus includes an autoregressive model configured to estimate a current signal from a past signal sequence and a current context label, a vocal tract feature analyzer configured to analyze an input speech signal to determine a vocal tract filter coefficient representing a vocal tract feature, a residual signal generator configured to output a residual signal, a quantization unit configured to quantize the residual signal output from the residual signal generator to generate a quantized residual signal, and a training controller configured to provide as a condition, a context label of an already known input text for the input speech signal corresponding to the already known input text to the autoregressive model and to train the autoregressive model by bringing a past sequence of the quantized residual signals for the input speech signal and the current context label into correspondence with a current signal of the quantized residual signal.

11 Claims, 9 Drawing Sheets

(51) Int. Cl.

| | |
|---|---|
| ***G10L 19/06*** | (2013.01) |
| ***G10L 13/047*** | (2013.01) |
| ***G10L 25/75*** | (2013.01) |

(56) References Cited

U.S. PATENT DOCUMENTS

| | | | | |
|---|---|---|---|---|
| 5,774,846 | A * | 6/1998 | Morii | G10L 19/06 704/202 |
| 6,240,384 | B1 * | 5/2001 | Kagoshima | G10L 13/07 704/220 |
| 2010/0004934 | A1 | 1/2010 | Hirose et al. | |

OTHER PUBLICATIONS

A. van den Oord et al., "Pixel Recurrent Neural Networks," arXiv preprint arXiv:1601.06759v3, 2016.

Kaneko, Takuhiro et al., "Generative Adversarial Network-based Postfiltering for Statistical Parametric Speech Synthesis," *IEICE Technical Report*, vol. 16, No. 378, pp. 89-94 (Dec. 13, 2016).

Written Opinion of the International Searching Authority issued in PCT Patent Application No. PCT/JP2018/006166 dated May 15, 2018.

International Search Report issued in PCT Patent Application No. PCT/JP2018/006166 dated May 15, 2018.

* cited by examiner

TRAINING APPARATUS, SPEECH SYNTHESIS SYSTEM, AND SPEECH SYNTHESIS METHOD

TECHNICAL FIELD

The present invention relates to speech synthesis technology for synthesizing and outputting a speech in accordance with an input text.

BACKGROUND ART

In the field of speech synthesis, statistical parametric speech synthesis (which will also be abbreviated as "SPSS" below) which is a framework for generating a speech signal based on a statistical model has conventionally actively been studied. In SPSS, correspondence between an input text and a speech signal corresponding to the text is statistically modeled. Since it is not easy to directly model such relation, the statistical model is constructed by expressing each of the input text and the speech signal as a sequence of feature values. Specifically, the input text is expressed as a sequence of context labels representing linguistic feature values and the speech signal is expressed by a sequence of acoustic feature values.

Instead of such a method of estimating a speech signal from a sequence of acoustic feature values, an approach referred to as "WaveNet" to direct estimation of a speech signal from a sequence of context labels has been proposed (see, for example, A. van den Oord et al., "WaveNet: A Generative Model for Raw Audio," arXiv preprint arXiv: 1609.03499, 2016, hereinafter "NPL 1"). This WaveNet has been reported to exhibit performance surpassing an already existing latest approach.

A signal estimated and output according to WaveNet disclosed in A. van den Oord et al., "WaveNet: A Generative Model for Raw Audio," arXiv preprint arXiv:1609.03499, 2016 is a speech signal quantized under a μ-law scheme. In estimation of a speech signal quantized under the μ-law scheme, an estimation error in restoration of a signal spreads over the entire band. Therefore, noise in particular in a high-frequency band tends to be sensed.

SUMMARY OF INVENTION

With the problem as described above being taken into consideration, an object of the present invention is to improve speech quality in direct estimation of a speech signal from a context label based on an input text.

According to one aspect of the present invention, a training apparatus for a speech synthesis system is provided. The training apparatus includes an autoregressive model configured to estimate a current signal from a past signal sequence and a current context label. The autoregressive model includes a network structure capable of statistical data modeling. The training apparatus includes a vocal tract feature analyzer configured to analyze an input speech signal to determine a vocal tract filter coefficient representing a vocal tract feature, a residual signal generator configured to output a residual signal between a speech signal predicted based on the vocal tract filter coefficient and the input speech signal, a quantization unit configured to quantize the residual signal output from the residual signal generator to generate a quantized residual signal, and a training controller configured to provide as a condition, a context label of an already known input text for an input speech signal corresponding to the already known input text to the autoregressive model and to train the autoregressive model by bringing a past sequence of the quantized residual signals for the input speech signal and the current context label into correspondence with a current signal of the quantized residual signal.

According to another aspect of the present invention, a speech synthesis system which synthesizes and outputs a speech in accordance with an input text is provided. The speech synthesis system includes a speech synthesis controller configured to provide as a condition, when an unknown input text is input, a context label of the unknown input text to the autoregressive model and to output a current quantized residual signal by using the autoregressive model constructed by the training apparatus according to claim 1 from a past estimated quantized residual signal.

Preferably, the speech synthesis system further includes an inverse quantization unit configured to generate an estimated residual signal by performing inverse quantization on the past quantized residual signal output from the quantization unit and the estimated quantized residual signal estimated from the current context label, a synthesis filter configured to output as a speech signal, a result of filtering of the estimated residual signal output from the inverse quantization unit based on the vocal tract filter coefficient, and a storage configured to store a vocal tract filter coefficient for the input speech signal.

Preferably, the vocal tract filter coefficient can be adjusted by an auditory weight coefficient.

Preferably, the speech synthesis system further includes a text analyzer configured to analyze the input text to generate context information and a context label generator configured to generate a context label of the input text based on the context information from the text analyzer.

According to yet another aspect of the present invention, a speech synthesis method of synthesizing and outputting a speech in accordance with an input text is provided. The speech synthesis method includes analyzing an input speech signal corresponding to an already known input text to determine a vocal tract filter coefficient representing a vocal tract feature, generating a residual signal between a speech signal predicted based on the vocal tract filter coefficient and the input speech signal, quantizing the residual signal to generate a quantized residual signal, and providing a context label of the already known input text to an autoregressive model as a condition and training the autoregressive model for estimating the quantized residual signal at a current time point from the quantized residual signal in a past and a current context label. The autoregressive model stores a parameter for estimating a current value from a past signal sequence and the current context label and includes a network structure capable of statistical data modeling.

According to the present invention, speech quality in direct estimation of a speech signal from a context label based on an input text can be improved.

DESCRIPTION OF EMBODIMENTS

Figure 1:
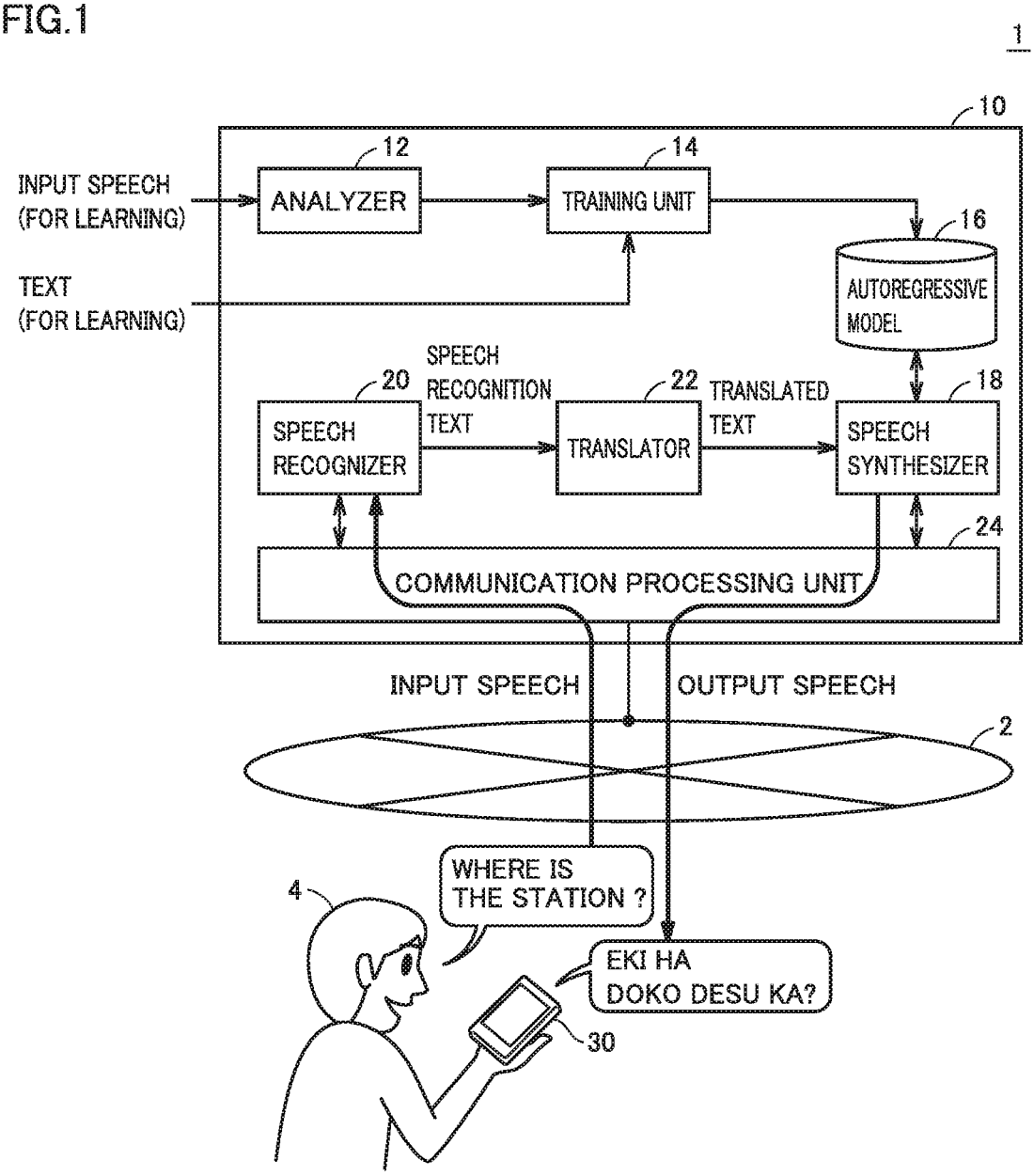
FIG. 1 is a schematic diagram showing overview of a multi-lingual translation system with the use of a speech synthesis system according to the present embodiment.

An embodiment of the present invention will be described in detail with reference to the drawings. The same or corresponding elements in the drawings have the same reference characters allotted and description thereof will not be repeated.

[A. Application]

An application of a speech synthesis system according to the present embodiment will initially be described. More specifically, a multi-lingual translation system with the use of the speech synthesis system according to the present embodiment will be described.

FIG. 1 is a schematic diagram showing overview of a multi-lingual translation system 1 with the use of a speech synthesis system according to the present embodiment. Referring to FIG. 1, multi-lingual translation system 1 includes a service providing apparatus 10. Service providing apparatus 10 synthesizes, by voice recognition and multi-lingual translation of input speeches (some words uttered in a first language) from a portable terminal 30 connected over a network 2, corresponding words in a second language, and outputs results of synthesis to portable terminal 30 as output speeches.

For example, when a user 4 utters English words "Where is the station?" toward portable terminal 30, portable terminal 30 generates input speeches from the uttered words through a microphone or the like, and transmits the generated input speeches to service providing apparatus 10. Service providing apparatus 10 synthesizes output speeches in Japanese "Eki ha doko desu ka?" which correspond to "Where is the station?" When portable terminal 30 receives the output speeches from service providing apparatus 10, it reproduces the received output speeches. A conversation partner of user 4 thus hears words "Eki ha doko desu ka?" in Japanese.

Though not shown, the conversation partner of user 4 may also have similar portable terminal 30. For example, when the conversation partner utters toward his/her portable terminal, an answer "Massugu itte hidari desu" to the question from user 4, processing as described above is performed and corresponding English words "Go straight and turn left" are given to user 4.

Thus, multi-lingual translation system 1 can freely do translation between words in the first language (speech) and words in the second language (speech). Without being limited to two languages, automatic translation among any number of languages may be done.

By utilizing such an automatic speech translation function, communication on the occasion of travel abroad or communication with foreigners can be facilitated.

The speech synthesis system according to the present embodiment included in service providing apparatus 10 uses an autoregressive model to reconstruct a corresponding speech signal from a sequence of context labels generated from an input text, as will be described later. Service providing apparatus 10 includes an analyzer 12, a training unit 14, an autoregressive model 16, and a speech synthesizer 18 as components relating to the speech synthesis system.

Service providing apparatus 10 includes a speech recognizer 20 and a translator 22 as components relating to automatic translation. Service providing apparatus 10 further includes a communication processing unit 24 for performing processing for communication with portable terminal 30.

More specifically, analyzer 12 and training unit 14 are responsible for machine learning for constructing autoregressive model 16. Analyzer 12 and training unit 14 function as a training apparatus for the speech synthesis system and constructs autoregressive model 16. Details of functions of and processing by analyzer 12 and training unit 14 (training apparatus) will be described later. Autoregressive model 16 corresponds to a result of machine learning by analyzer 12 and training unit 14.

Speech recognizer 20 outputs a speech recognition text by performing speech recognition processing onto input speeches from portable terminal 30 received via communication processing unit 24. Translator 22 generates a text in a designated language (which is also denoted as a "translated text" for the sake of convenience of description) from the speech recognition text from speech recognizer 20. Any known method can be adopted for speech recognizer 20 and translator 22.

Speech synthesizer 18 performs speech synthesis onto the translated text from translator 22 by referring to autoregressive model 16, and transmits resultant output speeches to portable terminal 30 through communication processing unit 24.

Though FIG. 1 shows an example in which a component (mainly analyzer 12 and training unit 14) responsible for machine learning for constructing autoregressive model 16 and a component (mainly speech recognizer 20, translator 22, and speech synthesizer 18) responsible for multi-lingual translation with the use of generated autoregressive model 16 are implemented on identical service providing apparatus 10 for the sake of convenience of description, these functions may be implemented on apparatuses different from each other. In this case, in a first apparatus, autoregressive model 16 may be constructed by carrying out machine learning, and in a second apparatus, speech synthesis and services based on the speech synthesis may be provided by using generated autoregressive model 16.

In multi-lingual translation service as described above, an application executed on portable terminal 30 may be responsible for at least one function of speech recognizer 20 and translator 22. Alternatively, an application executed on portable terminal 30 may be responsible for a function of a component responsible for speech synthesis (autoregressive model 16 and speech synthesizer 18).

As service providing apparatus 10 and portable terminal 30 thus cooperate in an arbitrary form, multi-lingual translation system 1 and the speech synthesis system representing a part of the former can be implemented. A function allocated to each apparatus should only be determined as appropriate depending on a condition, and limitation to multi-lingual translation system 1 shown in FIG. 1 is not intended.

[B. Hardware Configuration of Service Providing Apparatus]

Figure 2:
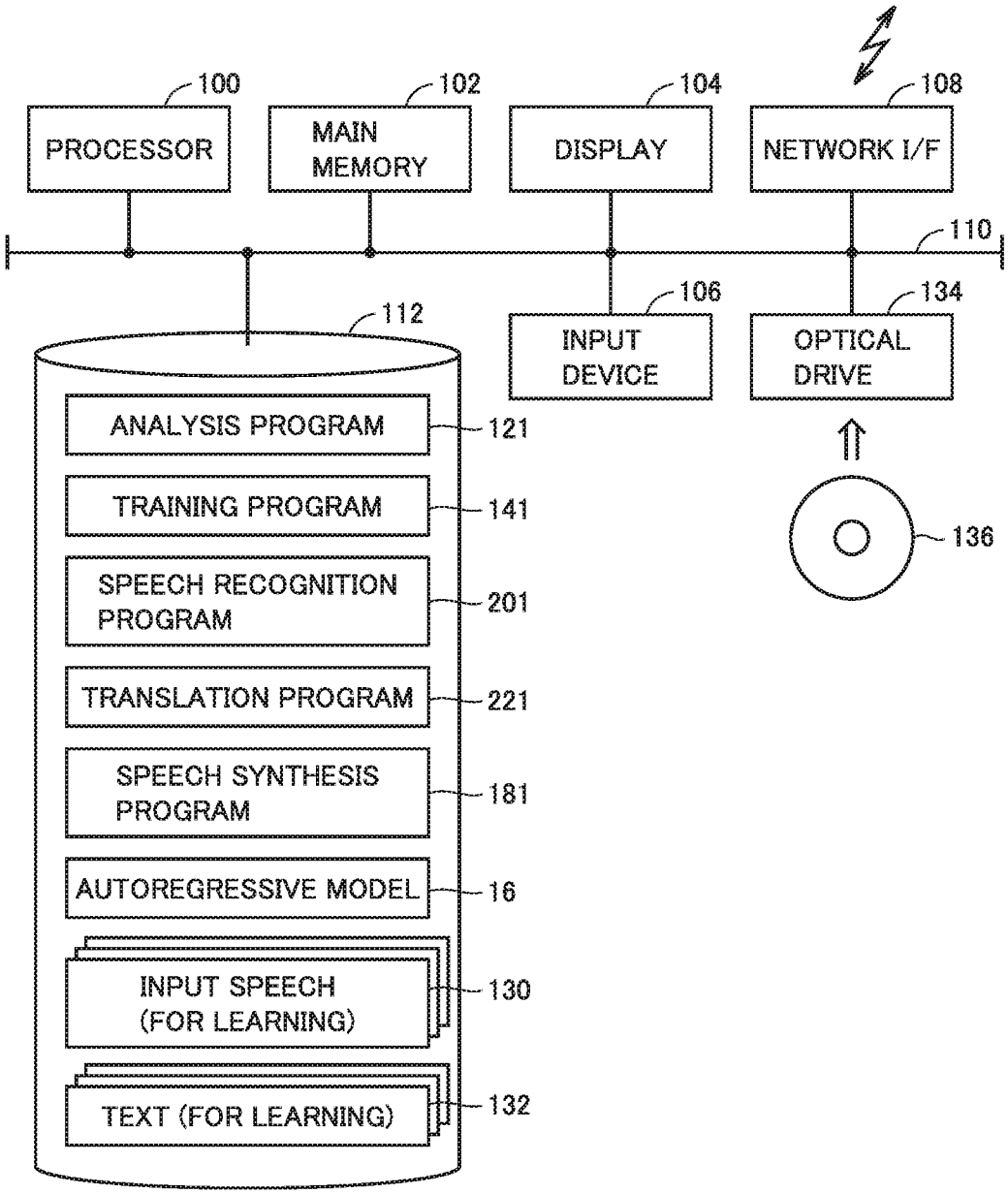
FIG. 2 is a schematic diagram showing an exemplary hardware configuration of a service providing apparatus according to the present embodiment.

One exemplary hardware configuration of the service providing apparatus will now be described. FIG. 2 is a schematic diagram showing an exemplary hardware configuration of service providing apparatus 10 according to the present embodiment. Service providing apparatus 10 is implemented typically by a general-purpose computer.

Referring to FIG. 2, service providing apparatus 10 includes a processor 100, a main memory 102, a display 104, an input device 106, a network interface (I/F) 108, an optical drive 134, and a secondary storage device 112 as main hardware components. These components are connected to one another through an internal bus 110.

Processor 100 is an operation entity which performs processing necessary for implementing service providing apparatus 10 according to the present embodiment by executing various programs as will be described later, and it is implemented, for example, by one central processing unit (CPU) or a plurality of CPUs or one graphics processing unit (GPU) or a plurality of GPUs. A CPU or a GPU including a plurality of cores may be employed.

Main memory 102 is a storage area where a program code or a work memory is temporarily stored in execution of a program by processor 100, and it is implemented, for example, by a volatile memory device such as a dynamic random access memory (DRAM) or a static random access memory (SRAM).

Display 104 is a display portion which outputs a user interface involved with processing or results of processing, and it is implemented, for example, by a liquid crystal display (LCD) or an organic electroluminescence (EL) display.

Input device 106 is a device which accepts an instruction or an operation from a user, and it is implemented, for example, by a keyboard, a mouse, a touch panel, and/or a pen. Input device 106 may include a microphone for collecting speeches necessary for machine learning or an interface for connection to a speech collection device which collects speeches necessary for machine learning.

Network interface 108 exchanges data with portable terminal 30 or any information processing apparatus on the Internet or an intranet. Any communication scheme such as Ethernet®, a wireless local area network (LAN), or Bluetooth® can be adopted for network interface 108.

Optical drive 134 reads information stored in an optical disc 136 such as a compact disc read only memory (CD-ROM) or a digital versatile disc (DVD) and outputs the information to other components through internal bus 110. Optical disc 136 represents one example of a non-transitory recording medium, and it is distributed as having any program stored thereon in a non-volatile manner. As optical drive 134 reads a program from optical disc 136 and installs the program into secondary storage device 112 or the like, a general-purpose computer functions as service providing apparatus 10 (or a speech synthesis apparatus). Therefore, a subject matter of the present invention can also be a program itself installed in secondary storage device 112 or a recording medium such as optical disc 136 which stores a program for performing functions or processing according to the present embodiment.

Though FIG. 2 shows an optical recording medium such as optical disc 136 by way of example of a non-transitory recording medium, limitation thereto is not intended and a semiconductor recording medium such as a flash memory, a magnetic recording medium such as a hard disk or a storage tape, or a magneto-optical recording medium such as a magneto-optical (MO) disk may be employed.

Secondary storage device 112 is a component which stores a program executed by processor 100, input data to be processed by the program (including input speeches and texts for learning and input speeches from portable terminal 30), and output data generated by execution of a program (including output speeches to be transmitted to portable terminal 30), and it is implemented, for example, by a non-volatile storage device such as a hard disk or a solid state drive (SSD).

More specifically, secondary storage device 112 typically stores an analysis program 121 for implementing analyzer 12, a training program 141 for implementing training unit 14, a speech recognition program 201 for implementing speech recognizer 20, a translation program 221 for implementing translator 22, and a speech synthesis program 181 for implementing speech synthesizer 18, in addition to a not-shown operating system (OS).

A part of a library or a functional module required in execution of these programs in processor 100 may be substituted by a library or a functional module provided as standard by the OS. In this case, though each program alone does not include all program modules necessary for performing corresponding functions, a necessary function can be performed by being installed in an OS-running environment. Even a program not including a part of a library or a functional module can also be encompassed within the technical scope of the present invention.

These programs are distributed not only as being stored in any recording medium as described above but also as being downloaded from a server apparatus through the Internet or an intranet.

Though a database for implementing speech recognizer 20 and translator 22 is actually required, such a database is not illustrated for the sake of convenience of description.

Secondary storage device 112 may store, in addition to autoregressive model 16, an input speech 130 for machine learning and a corresponding text 132 that are used for constructing autoregressive model 16.

Though FIG. 2 shows an example in which a single computer implements service providing apparatus 10, limitation thereto is not intended, and a plurality of computers connected over a network may explicitly or implicitly be coordinated to implement multi-lingual translation system 1 and the speech synthesis system implementing a part of the former.

All or some of functions performed by execution of a program by a computer (processor 100) may be performed by a hard-wired circuit such as an integrated circuit, for example, an application specific integrated circuit (ASIC) or a field-programmable gate array (FPGA).

A person skilled in the art could implement the multi-lingual translation system according to the present embodiment by using as appropriate technologies in accordance with times when the present invention is carried out.

[C. Overview]

The speech synthesis system according to the present embodiment is a system which synthesizes and outputs speeches in accordance with an input text, and lowers auditory noise generated over synthesized speeches by combining predictive quantization of input speeches and the autoregressive model disclosed in NPL 1 described above with each other.

Predictive quantization is an approach to quantization of a residual signal between a predicted value generated based on a prediction coefficient and an input signal, rather than direct quantization of the input signal. Predictive quantization separates the input signal into a prediction coefficient and a residual signal. When predictive quantization is applied to a speech signal, the prediction coefficient corresponds to a parameter representing a vocal tract filter and the residual signal corresponds to an excitation source. In the speech synthesis system according to the present embodiment, a residual signal is estimated by using an autoregressive model. Typically, a scheme referred to as WaveNet disclosed in NPL 1 described above may be adopted.

By adopting such predictive quantization, a spectral shape of noise generated from an estimation error is shaped and the noise is concentrated in a band high in power. With such an auditory masking effect, noise can be less likely to be sensed.

Unlike WaveNet disclosed in NPL 1 described above, a residual signal is estimated, and hence a necessary dynamic range can be narrower than in direct estimation of a speech signal. Therefore, with a quantization bit rate being identical, highly accurate quantization can be achieved and speech quality can be improved.

Figure 3:
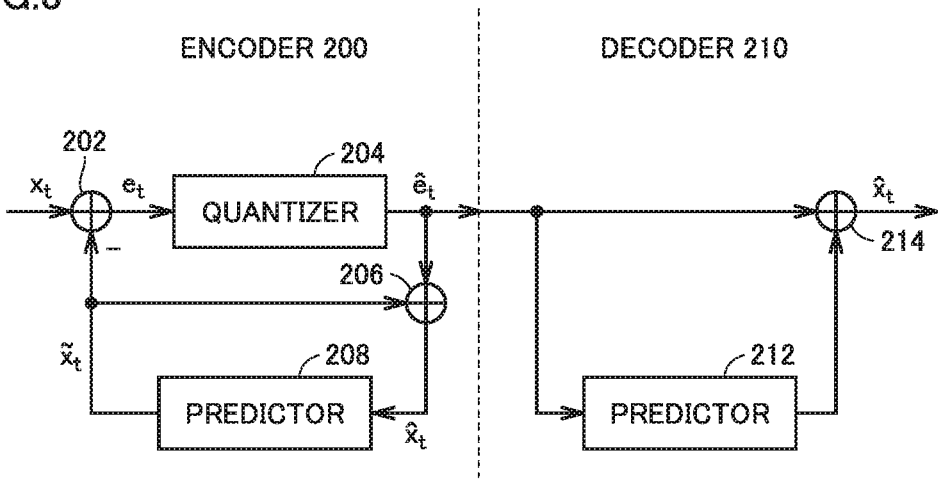
FIG. 3 is a block diagram for illustrating overview of predictive quantization adopted in the speech synthesis system according to the present embodiment.

Overview of predictive quantization will initially be described. FIG. 3 is a block diagram for illustrating overview of predictive quantization adopted in the speech synthesis system according to the present embodiment.

Referring to FIG. 3, predictive quantization includes an encoder 200 and a decoder 210 as a basic configuration. Encoder 200 separates an input signal into a prediction coefficient and a residual signal. Decoder 210 reconstructs an input signal from the residual signal.

More specifically, encoder 200 includes adders 202 and 206, a quantizer 204, and a predictor 208. In encoder 200, adder 202 calculates a residual signal $e_t$ between an input signal $x_t$ and $x\sim_t$ generated based on a past sample by predictor 208, and quantizer 204 quantizes calculated residual signal $e_t$ to calculate a quantized residual signal $e\hat{}_t$. Though "^" should basically be put above "e", "e" and "^" are juxtaposed for the sake of a usable character code. This is also applicable to "~".

Adder 206 performs addition of quantized residual signal $e\hat{}_t$ and $x\sim_t$ and a result of addition is given to predictor 208 as a predictive signal $x\hat{}_t$.

By applying predictor 208 to a predictive signal $x\hat{}_{t(t=t)}$ at time t, a predictive signal $x\hat{}_{t(t=t+1)}$ at time t+1 is calculated. Thus, in encoder 200, predictive signal $x\hat{}_t$ is calculated every cycle, and a difference between input signal $x_t$ and calculated predictive signal $x\hat{}_t$ is quantized and output as quantized residual signal $e\hat{}_t$.

Decoder 210 includes a predictor 212 which operates similarly to predictor 208 of encoder 200 and an adder 214. Adder 214 reconstructs predictive signal $x\hat{}_t$ corresponding to input signal $x_t$ by adding quantized residual signal $e\hat{}_t$ input every cycle and a result of prediction output from predictor 208 for quantized residual signal $e\hat{}_t$.

Through the procedure as described above, encoder 200 outputs quantized residual signal $e\hat{}_t$ for input signal $x_t$ every cycle and decoder 210 restores input signal $x_t$ based on quantized residual signal $e\hat{}_t$.

In the speech synthesis system according to the present embodiment, autoregressive model 16 for a quantized residual in accordance with a sequence of context labels is constructed by learning quantized residual signal $e\hat{}_t$.

[D. Training Processing and Speech Synthesis Processing]

Figure 4:
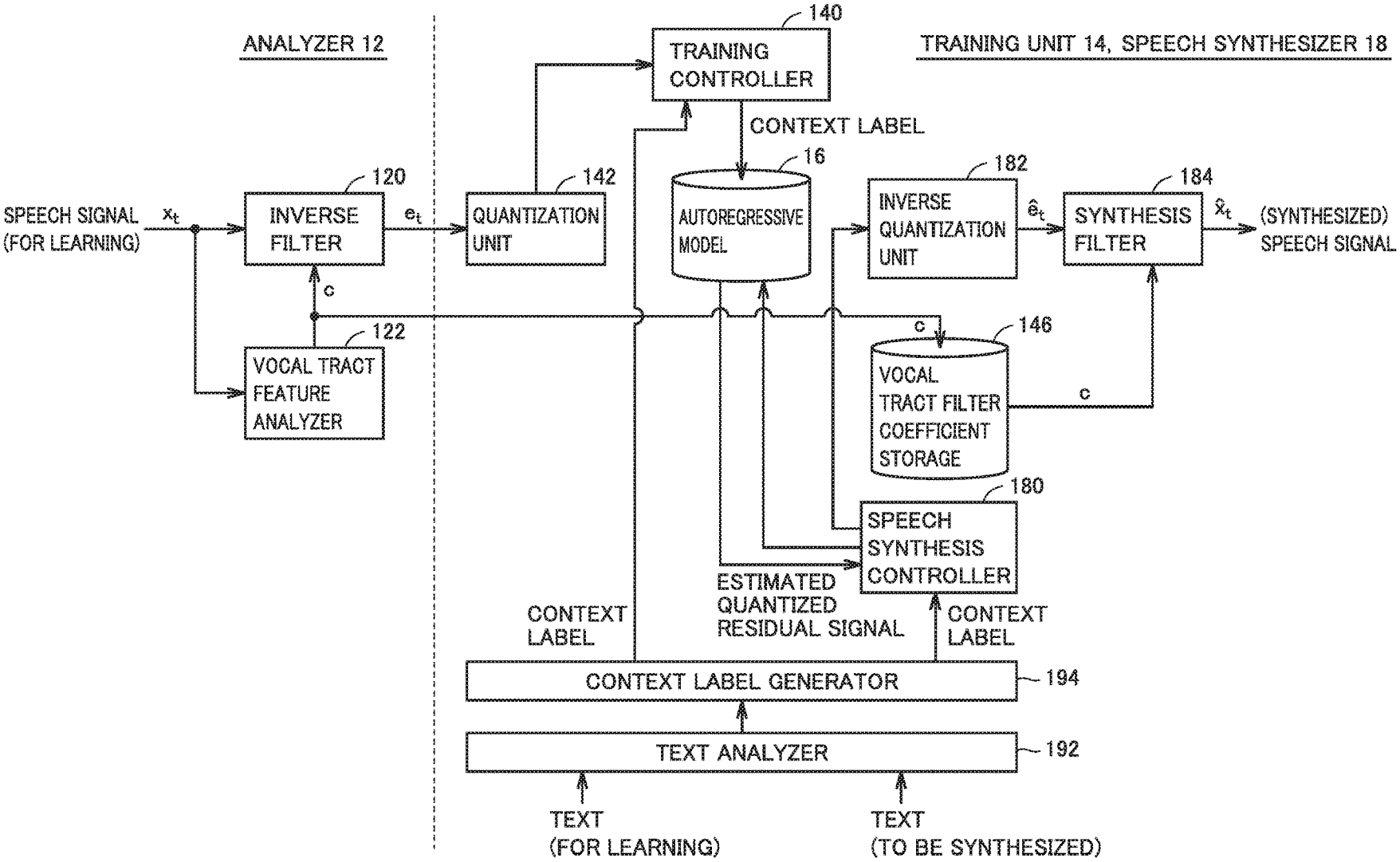
FIG. 4 is a block diagram for illustrating processing in a main portion of the speech synthesis system according to the present embodiment.

Details of training processing and speech synthesis processing in the speech synthesis system according to the present embodiment will now be described. FIG. 4 is a block diagram for illustrating processing in a main portion of the speech synthesis system according to the present embodiment.

Referring to FIG. 4, the speech synthesis system includes analyzer 12 and training unit 14 configured to construct autoregressive model 16 and speech synthesizer 18 configured to output a speech signal by using autoregressive model 16. Processing by and a function of each unit will be described in detail below.

(d1: Analyzer 12)

Processing by and a function of analyzer 12 will initially be described. Analyzer 12 is responsible for speech analysis, and it separates speech signal $x_t$ representing input speeches for learning into a vocal tract filter coefficient c and residual signal $e_t$ corresponding to an excitation source. In the present embodiment, vocal tract filter coefficient c is time-invariant.

More specifically, analyzer 12 includes an inverse filter 120 and a vocal tract feature analyzer 122. Vocal tract feature analyzer 122 analyzes input speech signal $x_t$ and outputs vocal tract filter coefficient c representing a vocal tract feature. Vocal tract feature analyzer 122 outputs vocal tract filter coefficient c to inverse filter 120 and has the vocal tract filter coefficient stored in a vocal tract filter coefficient storage 146. Any of a line spectral pair (LSP), linear prediction coefficients (LPC), and a mel-cepstral coefficient may be adopted as a filter coefficient. In [G. Experimental Evaluation] below shows an example in which a mel-cepstral coefficient is used.

Inverse filter 120 corresponds to a residual signal generator configured to output a residual signal between a speech signal predicted based on vocal tract filter coefficient c and an input speech signal. More specifically, inverse filter 120 internally predicts a speech signal based on vocal tract filter coefficient c from vocal tract feature analyzer 122 and outputs residual signal $e_t$ between input speech signal $x_t$ and the predicted speech signal. Residual signal $e_t$ output from inverse filter 120 is given to training unit 14.

(d2: Training Unit 14)

Processing by and a function of training unit 14 will now be described. Training unit 14 provides input of a quantized residual signal obtained by quantization of residual signal $e_t$ given from analyzer 12 to autoregressive model 16. A numerical distance between a quantized residual signal and an estimated quantized residual signal or cross-entropy of a one-hot vector in accordance with a quantization bit may be adopted as an error. Training unit 14 constructs autoregressive model 16 to minimize a difference (an estimation error) between a quantized residual error and a quantized estimation error.

Training unit 14 constructs autoregressive model 16 based on each context label corresponding to each sample and a speech signal input in the past. Essentially, autoregressive model 16 stores a parameter for estimating a current value from a past signal sequence and a current context label. More specifically, training unit 14 includes a training controller 140, a quantization unit 142, and vocal tract filter coefficient storage 146.

Though an error between quantized signals is minimized in the present embodiment, an error between estimated residual signal $e\hat{}_t$ and residual signal $e_t$ may be minimized.

The configuration shown in FIG. 4 includes a text analyzer 192 and a context label generator 194 as components configured to generate a sequence of context labels. Text analyzer 192 and context label generator 194 generate a context label based on context information of an already known text.

Since a context label is used in both of training unit 14 and speech synthesizer 18, an exemplary configuration used in common by training unit 14 and speech synthesizer 18 is shown. A component for generating a context label, however, may be implemented in each of training unit 14 and speech synthesizer 18.

Text analyzer 192 analyzes an input text for learning or to be synthesized and outputs context information thereof to context label generator 194. Context label generator 194 determines a context label of the input text for learning or to be synthesized based on the context information from text analyzer 192 and outputs the context label to training controller 140 and a speech synthesis controller 180.

Quantization unit 142 quantizes a residual signal output from inverse filter 120 (residual signal generator) to generate a quantized residual signal. The μ-law scheme may be adopted as a quantization scheme, or a quantization width may statistically or linearly be determined based on training data. A quantization bit rate may be set to sixteen bits generally used for speeches or may arbitrarily be set.

Training controller 140 trains autoregressive model 16, with the context label given from context label generator 194 being defined as a condition. Specifically, training controller 140 gives as a condition, a context label of an already known input text for an input speech signal corresponding to the already known input text to autoregressive model 16, and trains autoregressive model 16 by receiving input of a quantized residual signal for the input speech signal. Details and a method of constructing autoregressive model 16 will be described later.

Vocal tract filter coefficient storage 146 corresponds to a storage configured to store vocal tract filter coefficient c for an input speech signal.

(d3: Speech Synthesizer 18)

Processing by and a function of speech synthesizer 18 will now be described. Speech synthesizer 18 generates a context label for each sample generated from a text to be synthesized and inputs an estimated quantized residual signal in the past to autoregressive model 16 in accordance with a context label for each generated sample, to thereby obtain a current estimated quantized residual signal.

More specifically, speech synthesizer 18 includes speech synthesis controller 180, an inverse quantization unit 182, and a synthesis filter 184.

When any text to be synthesized is input, text analyzer 192 analyzes the input text and outputs context information, and context label generator 194 generates a context label based on the context information. Text analyzer 192 and context label generator 194 determine a context label based on the context information of the text in response to input of any text.

When speech synthesis controller 180 receives input of an unknown input text, it gives a context label of the unknown input text to autoregressive model 16 as a condition, provides an input of an estimated quantized residual signal in the past to autoregressive model 16, and obtains a current estimated quantized residual signal. The current estimated quantized residual signal is input as one point to be added to a past sequence, and estimates an estimated quantized residual signal at a time point one time-unit ahead. This estimation is repeated recursively until a final point.

Inverse quantization unit 182 generates estimated residual signal $\hat{e}_t$ by performing inverse quantization on the estimated quantized residual signal resulting from estimation by speech synthesis controller 180 until the last point.

Synthesis filter 184 outputs a synthesized speech signal by filtering the estimated residual signal from inverse quantization unit 182 based on vocal tract filter coefficient c read from vocal tract filter coefficient storage 146. In other words, synthesis filter 184 outputs as a speech signal, a result of filtering of the estimated residual signal output from inverse quantization unit 182 based on vocal tract filter coefficient c.

In the speech synthesis system according to the present embodiment, quantized residual signal $e_t$ is recursively estimated by autoregressive model 16 and speech synthesis controller 180, and a result of estimation is subjected to inverse quantization so that estimated residual signal $\hat{e}_t$ is generated. At this time, an estimation error ($|e_t-\hat{e}_t|$) is evenly distributed for each quantization bit. As estimated residual signal $\hat{e}_t$ is filtered by synthesis filter 184 based on vocal tract filter coefficient c, a speech spectrum of the generated speech signal is auditorily weighted. Consequently, the estimation error contained in estimated residual signal $\hat{e}_t$ can be concentrated in a band high in power in accordance with a shape of the speech spectrum. An auditory masking effect is thus exhibited, and noise included in synthesized speeches can be lowered.

[E. Autoregressive Model]

Autoregressive model 16 used in the speech synthesis system according to the present embodiment will now be described. A configuration similar to WaveNet disclosed in NPL 1 described above is assumed as autoregressive model 16.

WaveNet represents a generation model similar to PixelCNN (see, for example, A. van den Oord et al., "Pixel Recurrent Neural Networks," arXiv preprint arXiv: 1601.06759v3, 2016.08.19) and it is expressed as an autoregressive model which estimates a current sample (a current value) from a past signal sequence. A joint probability of speech signal $x=\{x_1, \ldots, x_T\}$ as being generalized can be expressed as a product of a conditional probability, as in an expression (1) below.

$$P(x) = \prod_{t=1}^{T} p(x_t \mid x_1, \ldots, x_{t-1}) \tag{1}$$

When text speech synthesis is carried out as in the speech synthesis system according to the present embodiment, a context label h can be added as a condition and modeled as a conditional probability p(x|h) as seen in an expression (2) below.

$$P(x \mid h) = \prod_{t=1}^{T} p(x_t \mid x_1, \ldots, x_{t-1}, h) \tag{2}$$

Figure 5:
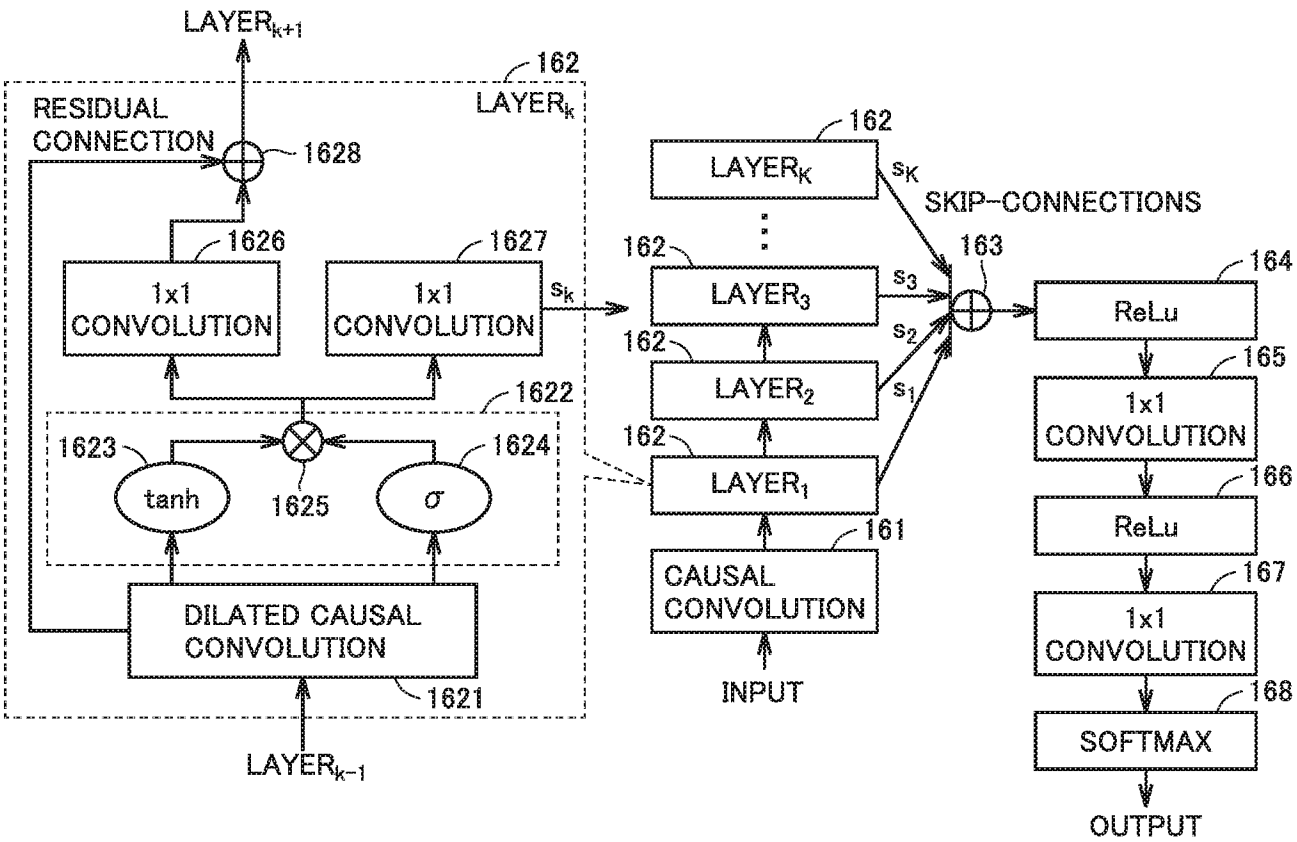
FIG. 5 is a block diagram for illustrating overview of an autoregressive model used in the speech synthesis system according to the present embodiment.

FIG. 5 is a block diagram for illustrating overview of autoregressive model 16 used in the speech synthesis system according to the present embodiment. As shown in FIG. 5, autoregressive model 16 according to the present embodiment includes a network structure capable of statistical data modeling.

Specifically, a network configuration of WaveNet is such that a plurality of $layers_k$ (162) are stacked for an input, with causal convolution (161) being interposed as shown in FIG. 5. Finally, $s_1, \ldots, s_K$ output as elements of skip connection from respective layers (162) are coupled in a coupling element (163).

After ReLu (activation functions 164 and 166) and convolutions (165 and 167) are applied to the coupled output, it is input to a softmax function (168). A signal output from the softmax function (168) is output as an estimated value.

In each layer (162), dilated causal convolution (1621) is used to efficiently model a past signal sequence. Dilated causal convolution (1621) achieves reduction in amount of computation and learning of global change by skipping an input signal every certain sample and convoluting it.

An output from dilated causal convolution (1621) is input to a gated activation unit (1622). In the gated activation unit (1622), the output from dilated causal convolution (1621) is input to a hyperbolic function 1623 and a sigmoid function 1624. An element-wise product of outputs from hyperbolic function 1623 and sigmoid function 1624 is computed in an Hadamard element 1625.

In contrast to an input vector $x_k$ to $layer_k$ (162), an output vector $z_k$ from the gated activation unit (1622) can be calculated in accordance with an expression (3) below:

$$z_k = \tan h(W_{filter,k} * x_k + b_{filter,k}) \circ \sigma(W_{gate,k} * x_k + b_{gate,k}) \quad (3)$$

where * represents convolution operation, ° represents element-wise multiplication (for each element), σ( ) represents a sigmoid function, k represents an index of a layer, $W_{filter,k}$ and $W_{gate,k}$ represent convolution filters $layer_k$, and for $b_{filter,k}$ represent convolution bias terms of $layer_k$.

After residual connection (1628) is applied to output vector $z_k$, it is given as an input to a next layer. In residual connection (1628), input vector $x_k$ is added to output vector $z_k$. After 1×1 convolution is applied to output vector $z_k$, it is output as an element $s_k$ of skip connection.

In the autoregressive model shown in FIG. 5, when cross entropy based on softmax rather than a square error is adopted as an error function, substitution to a multiclass problem of an amplitude value of a speech signal, not an error minimum problem of a mean vector which assumes Gaussian distribution, is made. By such problem substitution, more flexible and ambiguous distribution can be modeled under no hypothesis for an input being provided.

In WaveNet disclosed in NPL 1, the μ-law scheme is adopted for quantization, and a quantized signal is distributed at even probability at each quantization bit. Since the problem is a multi-class problem, estimation errors produced by WaveNet are also evenly distributed and the estimation errors are evenly distributed over a reconstructed signal. Consequently, noise is relatively high in a band low in signal power (in particular, a high-frequency band) and noise tends to be sensed. In contrast, the speech synthesis system according to the present embodiment solves such a problem by combining predictive quantization.

In the speech synthesis system according to the present embodiment, a speech signal can directly be reconstructed in accordance with an autoregressive model without being limited to WaveNet disclosed in NPL 1, and the speech synthesis system is applicable to any network configuration.

[F. Processing Procedure]

Figure 6:
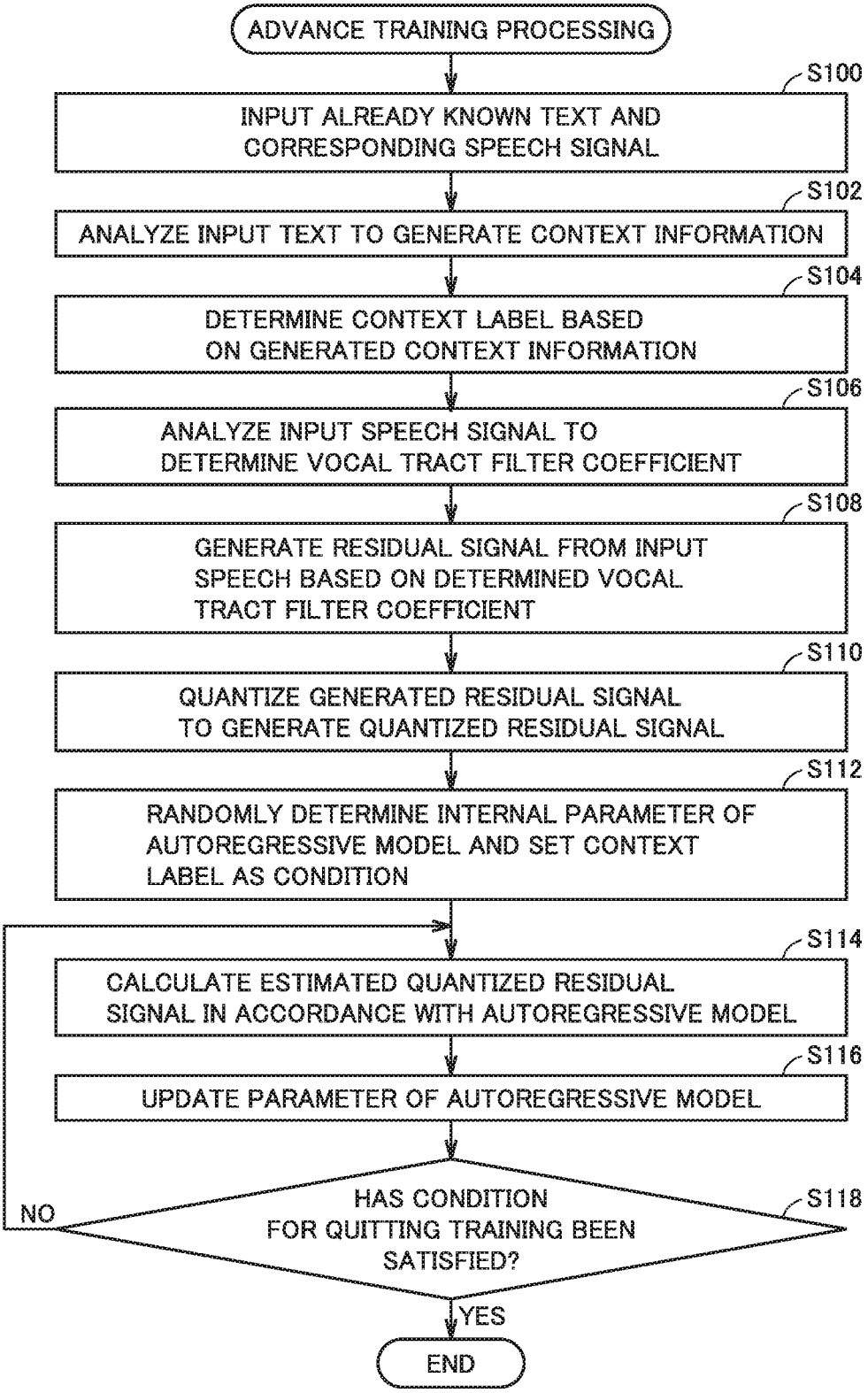
FIG. 6 is a flowchart showing one example of a processing procedure in the speech synthesis system according to the present embodiment.
Figure 7:
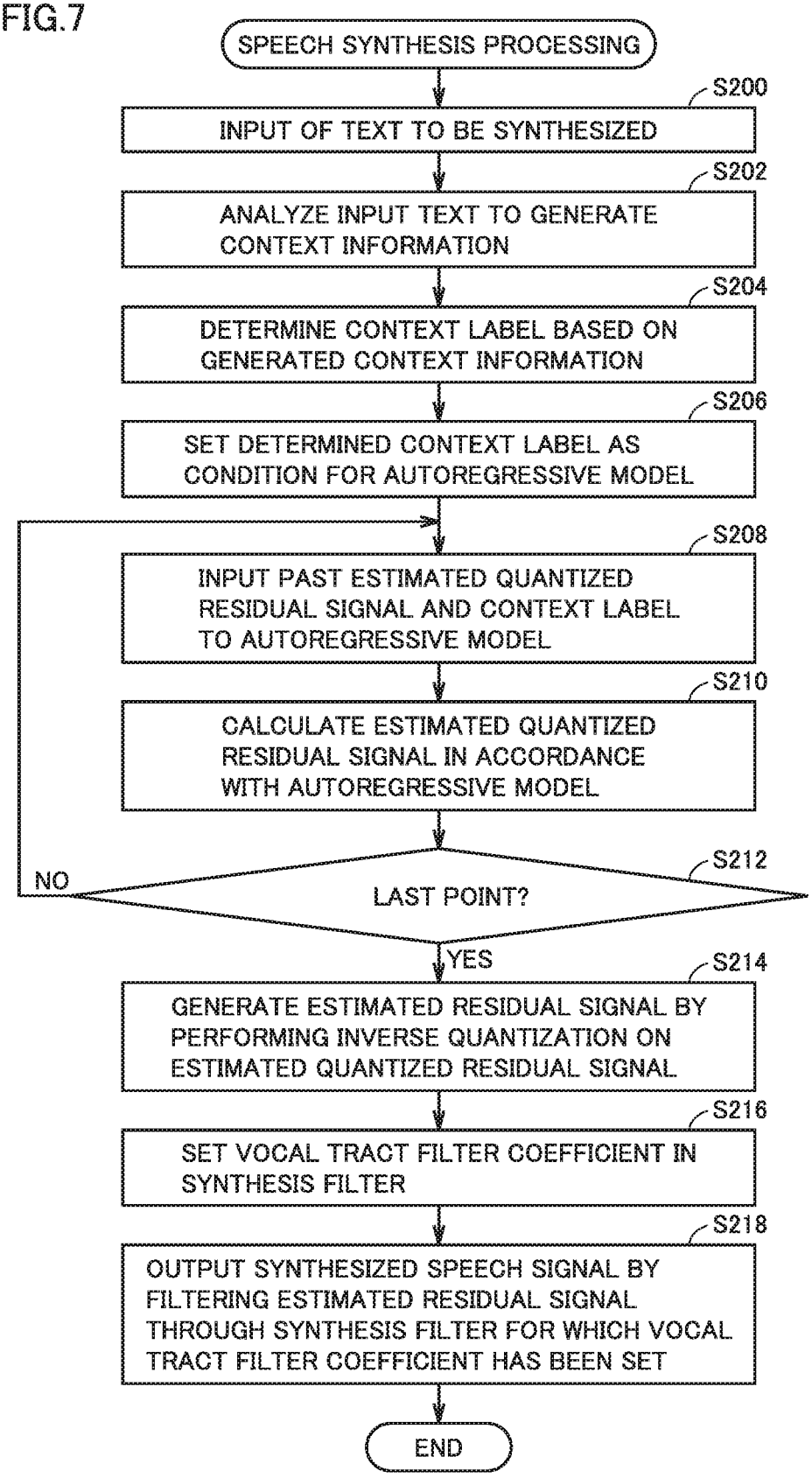
FIG. 7 is a flowchart showing one example of a processing procedure in the speech synthesis system according to the present embodiment.

FIGS. 6 and 7 are flowcharts showing one example of a processing procedure in the speech synthesis system according to the present embodiment. More specifically, FIG. 6 shows a procedure involved with advance training processing for constructing autoregressive model 16 and FIG. 7 shows a procedure involved with speech synthesis processing by using autoregressive model 16. Each step shown in FIGS. 6 and 7 may be performed by execution of one program or a plurality of programs by one processor or a plurality of processors (for example, processor 100 shown in FIG. 2).

Referring to FIG. 6, when processor 100 receives input of an already known text and a speech signal corresponding to the text (step S100), it analyzes the input text to generate context information (step S102) and determines a context label based on the generated context information (step S104).

In succession, processor 100 analyzes the input speech signal to determine a vocal tract filter coefficient (step S106), and generates a residual signal from the input speech signal based on the determined vocal tract filter coefficient (step S108). Processor 100 quantizes the generated residual signal to generate a quantized residual signal (step S110).

Then, processor 100 randomly determines an internal parameter of autoregressive model 16 and sets the determined context label as a condition (step S112) and trains autoregressive model 16 by bringing a past quantized residual signal and a current context label into correspondence with a current quantized residual signal (steps S114 and S116).

Processor 100 calculates an estimated quantized residual signal in accordance with autoregressive model 16 (step S116). Then, processor 100 determines whether or not a condition for quitting training has been satisfied (step S118). For example, the number of input speech signals reaching a defined value or an estimation error of an estimated value from the autoregressive model being equal to or lower than a predetermined threshold value is assumed as a condition for quitting training.

When the condition for quitting training has not been satisfied (NO in step S118), processing in step S114 and later is repeated. As the processing in steps S114 to S118 is repeated, autoregressive model 16 is constructed to minimize a difference (an estimation error) between a residual signal input to the autoregressive model and the estimated residual signal.

Thus, a context label of an already known input text is given to autoregressive model 16 as a condition and a quantized residual signal is input to autoregressive model 16 so that autoregressive model 16 is trained.

When the condition for quitting training has been satisfied (YES in step S118), training processing ends.

Then, referring to FIG. 7, when processor 100 receives input of a text to be synthesized (step S200), it analyzes the input text to generate context information (step S202) and determines a context label for a corresponding frame based on the generated context information (step S204). Then, processor 100 sets the context label determined in step S204 as a condition for autoregressive model 16 (step S206).

In succession, processor 100 inputs a past estimated quantized residual signal and the context label to autoregressive model 16 (step S208), and calculates an estimated quantized residual signal for the input in accordance with autoregressive model 16 (step S210). Then, processor 100 determines whether or not processing until the final point in autoregressive model 16 has been completed (step S212). When processing until the final point has not been completed (NO in step S212), processing in step S208 and later is repeated.

When processing until the final point has been completed (YES in step S212), processor 100 generates an estimated residual signal by performing inverse quantization on the estimated quantized residual signal that has recursively been estimated (step S214), sets a vocal tract filter coefficient in the synthesis filter (vocal tract filter) (step S216), and outputs a synthesized speech signal by filtering the generated estimated residual signal through the synthesis filter for which the vocal tract filter coefficient has been set (step S218). Speech synthesis processing onto the input text thus ends.

Thus, a context label of an unknown input text is given to autoregressive model 16 as a condition, and a current quantized residual signal is recursively estimated by using autoregressive model 16 from a past estimated quantized residual signal. A speech signal is reconstructed from the estimated current quantized residual signal.

[G. Experimental Evaluation]

Experimental evaluation made in connection with effectiveness in lowering in noise in the speech synthesis system according to the present embodiment will now be described. To that end, a context label as a condition was not given but only a correct speech waveform was given as an input.

(g1: Conditions in Experiment)

A Comparative Example to be compared with an Example according to the present embodiment employed WaveNet disclosed in NPL 1 described above.

As speech data, 7395 sentences including ATR phonetically balanced sentences and travel conversation sentences uttered by one female Japanese speaker were used. Among these sentences, 7365 sentences were used as training data and 30 remaining sentences were used as test data.

Speech data which had a sample frequency of 48 kHz down-sampled to 16 kHz and from which a component equal to or lower than 50 Hz had been removed by application of a high-pass filter was employed. An 8-bit μ-law scheme was employed as the quantization scheme, and one-hot vector was given as an input to the autoregressive model (WaveNet).

A 119th-order (120th-order inclusive of 0th-order) mel-cepstral coefficient was employed as vocal tract filter coefficient c (synthesis filter) in Example. In present evaluation, a residual signal was generated by filtering with the use of a time-invariant mel-cepstral coefficient calculated from training data. The residual signal was normalized within a range from −1 to 1.

An auditory weight coefficient was adopted for auditory weighting by a vocal tract filter. Specifically, intensity of auditory weighting was adjusted by varying a dynamic range of an auditory weight filter by multiplying each mel-cepstral coefficient except for the 0th-order mel-cepstral coefficient by a constant.

The vocal tract filter coefficient may thus be adjustable by an auditory weight coefficient.

A network configuration in which a filter length of causal convolution was set to 32, the number of elements in skip connection was set to 50, and five stacks of ten dilated causal convolution layers with dilation ranging from 1, 2, 4, and 8 to 512 samples were provided was adopted as a network configuration of the autoregressive model (WaveNet). In the network configuration employed in present evaluation, a receptive field had 320 ms (5120 samples). A length of a filter of residual connection was set to 2 and the number of output channels thereof was set to 32, and a length of a filter of skip connection was set to 2 and the number of output channels thereof was set to 512.

Adam was adopted as an optimizer of model training, a training coefficient was set to 1.0 $e^{-3}$, a batch size was set to 100,000 samples, and the number of times of trial was set to one hundred thousand.

In executing a program, three GPUs were used to equally divide a batch size and to perform parallel training.

"Comparative Example" employed a scheme using WaveNet disclosed in NPL 1 described above and estimated a current sample from a past speech signal sequence quantized under the μ-law scheme.

"Example" corresponded to the speech synthesis system according to the present embodiment as described above and provided an autoregressive model for predictive quantization. A current sample was estimated from a past residual signal sequence by using WaveNet. An estimated speech signal was obtained by filtering the estimated residual signal through a vocal tract filter.

A source signal was employed as an input at the time of generation of a speech in each of "Comparative Example" and "Example".

(g2: Results in Experiment: Noise Shaping)

Evaluation of results in an experiment of a noise shaping effect by auditory weighting will initially be described. Specifically, frequency characteristics of an error between a speech signal generated in a method as will be described below and a source signal were analyzed.

Figure 8:
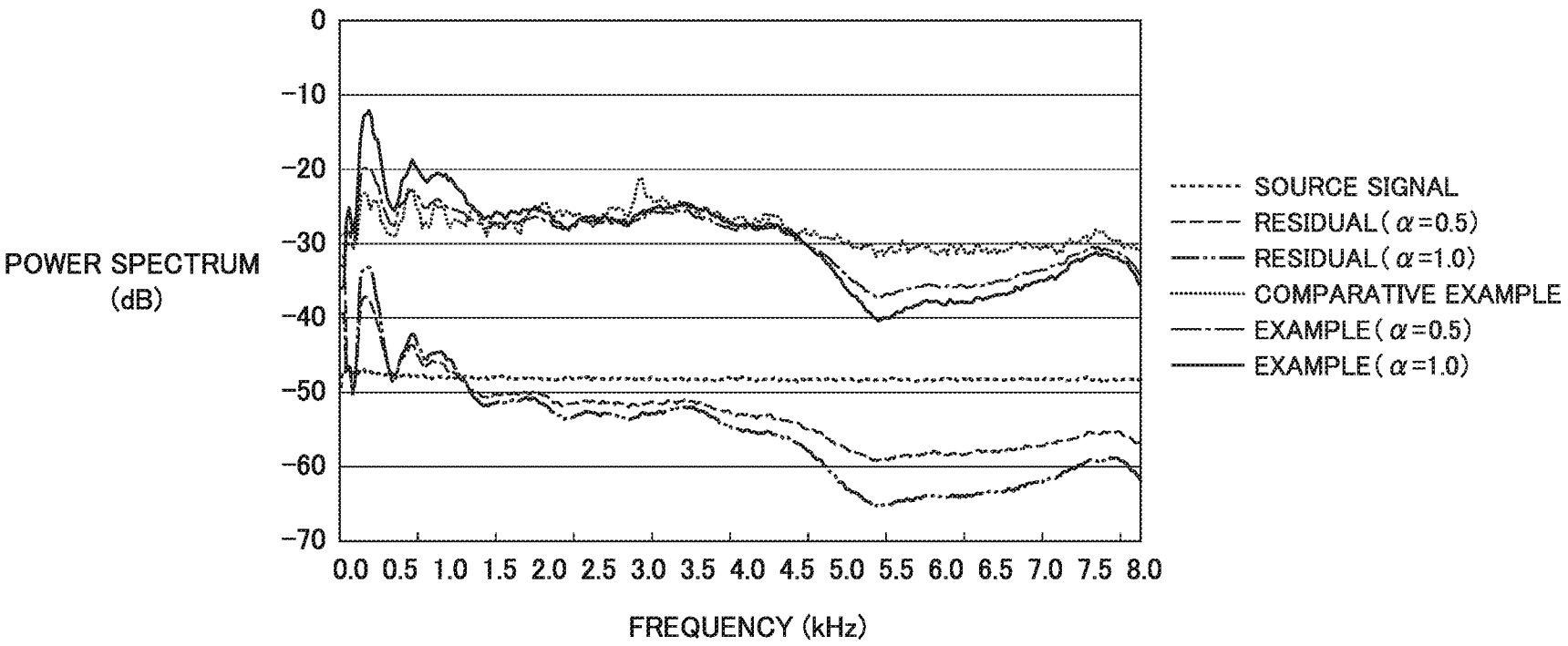
FIG. 8 is a diagram showing one example of a result of evaluation of a noise shaping effect in connection with the speech synthesis system according to the present embodiment.

FIG. 8 is a diagram showing one example of a result of evaluation of a noise shaping effect in connection with the speech synthesis system according to the present embodiment. FIG. 8 shows a result of sampling and averaging of ten sentences from test data. A legend in FIG. 8 means as below. a represents an auditory weight coefficient adopted in Example.

"Source signal": means an error between a source signal and a signal resulting from quantization of the source signal under the μ-law scheme followed by further inverse quantization and reconstruction. Namely, the source signal exhibits frequency characteristics of an error caused by quantization under the μ-law scheme.

"Residual (α=0.5)" and "residual (α=1.0)": each mean an error between a source signal and a signal obtained when a residual signal to be used in Example was quantized under the μ-law scheme followed by inverse quantization and reconstruction and the reconstructed signal was filtered through a vocal tract filter. Namely, the residual exhibits frequency characteristics of an error caused when it was assumed that there was no error in estimation by using the autoregressive model.

"Comparative example": means an error between a source signal and a signal obtained when a signal resulting from quantization of the source signal under the μ-law scheme was estimated by WaveNet and the estimated signal was thereafter subjected to inverse quantization for reconstruction. Namely, Comparative Example exhibits frequency characteristics of an error caused in Comparative Example.

"Example (α=0.5)" and "example (α=1.0)": each mean an error between a source signal and a signal obtained when a residual signal to be used in Example was quantized under the μ-law scheme, the quantized signal was estimated by using the autoregressive model, and thereafter the estimated signal was subjected to inverse quantization for reconstruction. Namely, Examples exhibit frequency characteristics of an error caused in Examples.

According to the results in the experiment shown in FIG. 8, it can be seen that a residual is distributed evenly over the entire band in "source signal" and "Comparative Example" as assumed. In contrast, "residual" and "Example" each have a peak around 200 Hz to 300 Hz and they are lower in power in a high-frequency band than "source signal" and "Comparative Example." Shaping in accordance with auditory characteristics can be confirmed also from a shape of a power spectrum in "residual" and "Example".

It can also be confirmed that a shape of the power spectrum was also varied to follow magnitude of auditory weight coefficient α and that a degree of shaping could be controlled by adjusting auditory weight coefficient α.

In FIG. 8, "source signal" and "residual" contain a quantization error and "Comparative Example" and "Example" contain an estimation error and a quantization error. It can be confirmed based on comparison of these that the estimation error is much greater than the quantization error.

(g3: Objective Evaluation)

An S/N ratio (SNR) between a source signal and an estimated speech signal was used as an indicator for objective evaluation of Example and Comparative Example. A table below shows a result thereof.

Though Example exhibited slightly better results than Comparative Example when auditory weight coefficient α was set to 0.1, it was poorer in other examples. Based on this result, shaping of a speech spectrum does not seem to much contribute to improvement in SNR of a source signal.

TABLE 1

| | SNR (dB) |
|---|---|
| Example (α = 0.1) | 17.3 |
| Example (α = 0.5) | 16.8 |
| Example (α = 1.0) | 16.1 |
| Comparative Example | 17.2 |

[g4: Subjective Evaluation]

Then, naturalness of a synthesized speech was compared between Example and Comparative Example based on a pairwise comparison experiment. Thirty sentences extracted from the test data were adopted as speeches to be used for evaluation. A synthesized speech generated in each of Example and Comparative Example was listened by subjects (three males and two females) and a speech felt more natural (higher in speech quality) was selected by the subjects. When no difference was felt between a pair of presented speeches, an option "neither" was allowed.

Figure 9:
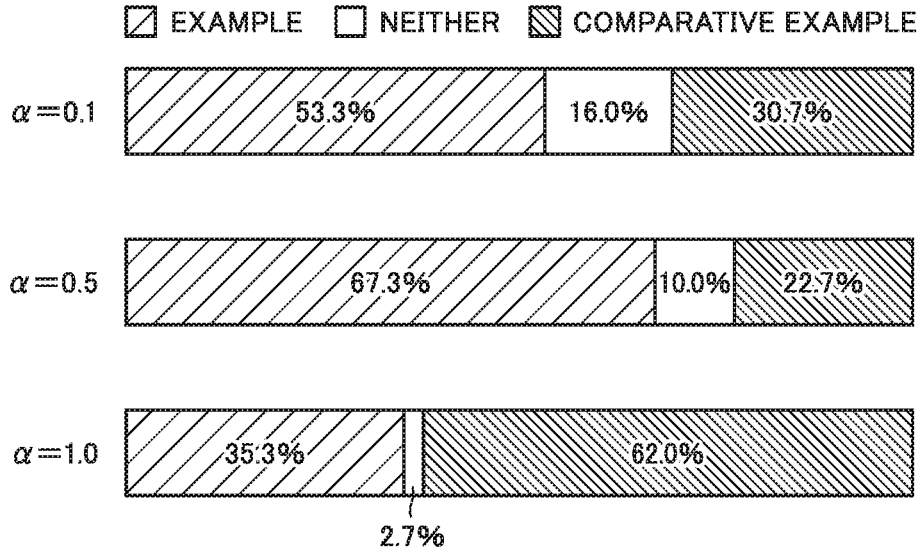
FIG. 9 is a diagram showing an exemplary result of evaluation in a pairwise comparison experiment in connection with the speech synthesis system according to the present embodiment.

FIG. 9 is a diagram showing an exemplary result of evaluation in the pairwise comparison experiment in connection with the speech synthesis system according to the present embodiment. In FIG. 9, p values at auditory weight coefficients α=0.1, 0.5, and 1.0 were 2.0 $e^{-3}$, 7.2 $e^{-10}$, and 0.8 $e^{-3}$, respectively. With auditory weight coefficient α=1.0, Comparative Example exhibited a significant difference ($p<0.01$) from Example, whereas, with auditory weight coefficients α=0.1 and 0.5, Example exhibited a significant difference from Comparative Example.

[H. Summary]

According to the speech synthesis system in the present embodiment, an approach to predictive quantization is combined with the autoregressive model for estimating a current value from a past signal sequence, so that noise which has been present over the entire band of a reconstructed speech signal can be shaped in consideration of auditory masking. Speech quality in direct estimation of a speech signal from a context label based on an input text can thus be improved.

It should be understood that the embodiment disclosed herein is illustrative and non-restrictive in every respect. The scope of the present invention is defined by the terms of the claims rather than the description of the embodiment above and is intended to include any modifications within the scope and meaning equivalent to the terms of the claims.

The invention claimed is:

1. A training apparatus for a speech synthesis system comprising:

an autoregressive model configured to estimate a current signal from a past signal sequence and a current context label, the autoregressive model including a network structure capable of statistical data modeling;

a vocal tract feature analyzer configured to analyze an input speech signal to determine a vocal tract filter coefficient representing a vocal tract feature;

a residual signal generator configured to output a residual signal between a speech signal predicted based on the vocal tract filter coefficient and the input speech signal;

a quantization unit configured to quantize the residual signal output from the residual signal generator to generate a quantized residual signal; and a training controller configured to provide as a condition, a context label of an already known input text for an input speech signal corresponding to the already known input text to the autoregressive model and to train the autoregressive model by bringing a past sequence of the quantized residual signals for the input speech signal and the current context label into correspondence with a current signal of the quantized residual signal.

2. A speech synthesis system which synthesizes and outputs a speech in accordance with an input text, the speech synthesis system comprising:

a speech synthesis controller configured to provide as a condition, when an unknown input text is input, a context label of the unknown input text to the autoregressive model and to output a current quantized residual signal by using the autoregressive model constructed by the training apparatus according to claim 1 from a past estimated quantized residual signal.

3. The speech synthesis system according to claim 2, further comprising:

an inverse quantization unit configured to generate an estimated residual signal by performing inverse quantization on a past quantized residual signal output from the quantization unit and the estimated quantized residual signal estimated from the current context label;

a synthesis filter configured to output as a speech signal, a result of filtering of the estimated residual signal output from the inverse quantization unit based on the vocal tract filter coefficient; and a storage configured to store a vocal tract filter coefficient for the input speech signal.

4. The speech synthesis system according to claim 2, wherein the vocal tract filter coefficient can be adjusted by an auditory weight coefficient.

5. The speech synthesis system according to claim 2, further comprising:

a text analyzer configured to analyze the input text to generate context information; and a context label generator configured to generate a context label of the input text based on the context information from the text analyzer.

6. A speech synthesis method of synthesizing and outputting a speech in accordance with an input text, comprising:

analyzing an input speech signal corresponding to an already known input text to determine a vocal tract filter coefficient representing a vocal tract feature;

generating a residual signal between a speech signal predicted based on the vocal tract filter coefficient and the input speech signal;

quantizing the residual signal to generate a quantized residual signal; and providing a context label of the already known input text to an autoregressive model as a condition and training the autoregressive model for estimating the quantized residual signal at a current time point from the quantized residual signal in a past and a current context label, the autoregressive model storing a parameter for estimating a current value from a past signal sequence and the current context label and including a network structure capable of statistical data modeling.

7. The speech synthesis system according to claim 3, wherein the vocal tract filter coefficient can be adjusted by an auditory weight coefficient.

8. The speech synthesis system according to claim 3, further comprising:

a text analyzer configured to analyze the input text to generate context information; and a context label generator configured to generate a context label of the input text based on the context information from the text analyzer.

9. The speech synthesis system according to claim 4, further comprising:

a text analyzer configured to analyze the input text to generate context information; and a context label generator configured to generate a context label of the input text based on the context information from the text analyzer.

10. The speech synthesis method according to claim 6, further comprising:

adjusting the vocal tract filter coefficient by an auditory weight coefficient.

11. The speech synthesis method according to claim 6, further comprising:

analyzing the input text to generate context information; and generating a context label of the input text based on the context information from the text analyzer.

* * * * *